US009581940B1

(12) United States Patent
Hara et al.

(10) Patent No.: US 9,581,940 B1
(45) Date of Patent: Feb. 28, 2017

(54) TRANSFER DEVICE AND IMAGE FORMING APPARATUS

(71) Applicant: FUJI XEROX CO., LTD., Tokyo (JP)

(72) Inventors: Sota Hara, Kanagawa (JP); Yoshiyuki Takashima, Kanagawa (JP); Hiroaki Yagi, Kanagawa (JP); Masakazu Shirai, Kanagawa (JP); Koji Deguchi, Kanagawa (JP); Kentaro Iwamoto, Kanagawa (JP); Yuta Hiramine, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/993,720

(22) Filed: Jan. 12, 2016

(30) Foreign Application Priority Data

Sep. 9, 2015 (JP) ..... 2015-177825

(51) Int. Cl.
*G03G 15/16* (2006.01)

(52) U.S. Cl.
CPC ..... *G03G 15/1615* (2013.01)

(58) Field of Classification Search
CPC ..... G03G 15/0136
See application file for complete search history.

(56) References Cited

U.S. PATENT DOCUMENTS 8,577,266 B2 * 11/2013 Shiba ..... G03G 15/0194 399/308
2011/0211855 A1 * 9/2011 Kogure ..... G03G 15/1615 399/66
2012/0237260 A1 9/2012 Sengoku et al.

FOREIGN PATENT DOCUMENTS

JP 2001-013800 A 1/2001
JP 2012-194472 A 10/2012

* cited by examiner

*Primary Examiner* — Clayton E Laballe
*Assistant Examiner* — Victor Verbitsky
(74) *Attorney, Agent, or Firm* — Oliff PLC

(57) ABSTRACT

Provided is a transfer device including a primary transfer roller that selectively takes a contact position where an intermediate transfer belt is brought into contact with an image holding member, and a separation position where the intermediate transfer belt is separated from the image holding member, a tension applying roller on which the intermediate transfer belt is wound thereon together with a driving roller and which is urged in a direction receding from the driving roller, and a relaxing member that is attached to a shaft portion of the tension applying roller, is urged by an urging unit in a direction approaching the driving roller, and relaxes an urging force of the tension applying roller in a direction receding from the driving roller when the primary transfer roller is at the separation position.

10 Claims, 8 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2015-177825 filed Sep. 9, 2015.

BACKGROUND

Technical Field

The present invention relates to a transfer device and an image forming apparatus.

SUMMARY

According to an aspect of the invention, there is provided a transfer device including:

a primary transfer roller that selectively takes a contact position where an intermediate transfer belt is brought into contact with an image holding member, and a separation position where the intermediate transfer belt is separated from the image holding member;

a tension applying roller on which the intermediate transfer belt is wound thereon together with a driving roller and which is urged in a direction receding from the driving roller; and a relaxing member that is attached to a shaft portion of the tension applying roller, is urged by an urging unit in a direction approaching the driving roller, and relaxes an urging force of the tension applying roller in a direction receding from the driving roller when the primary transfer roller is at the separation position.

BRIEF DESCRIPTION OF THE DRAWINGS

Exemplary embodiments of the present invention will be described in detail based on the following figures, wherein:

FIG. 5A illustrates a state before sliding, and FIG. 5B illustrates a state after sliding;

FIG. 8A illustrates image formation, and FIG. 8B illustrates retraction.

DETAILED DESCRIPTION

Figure 1:
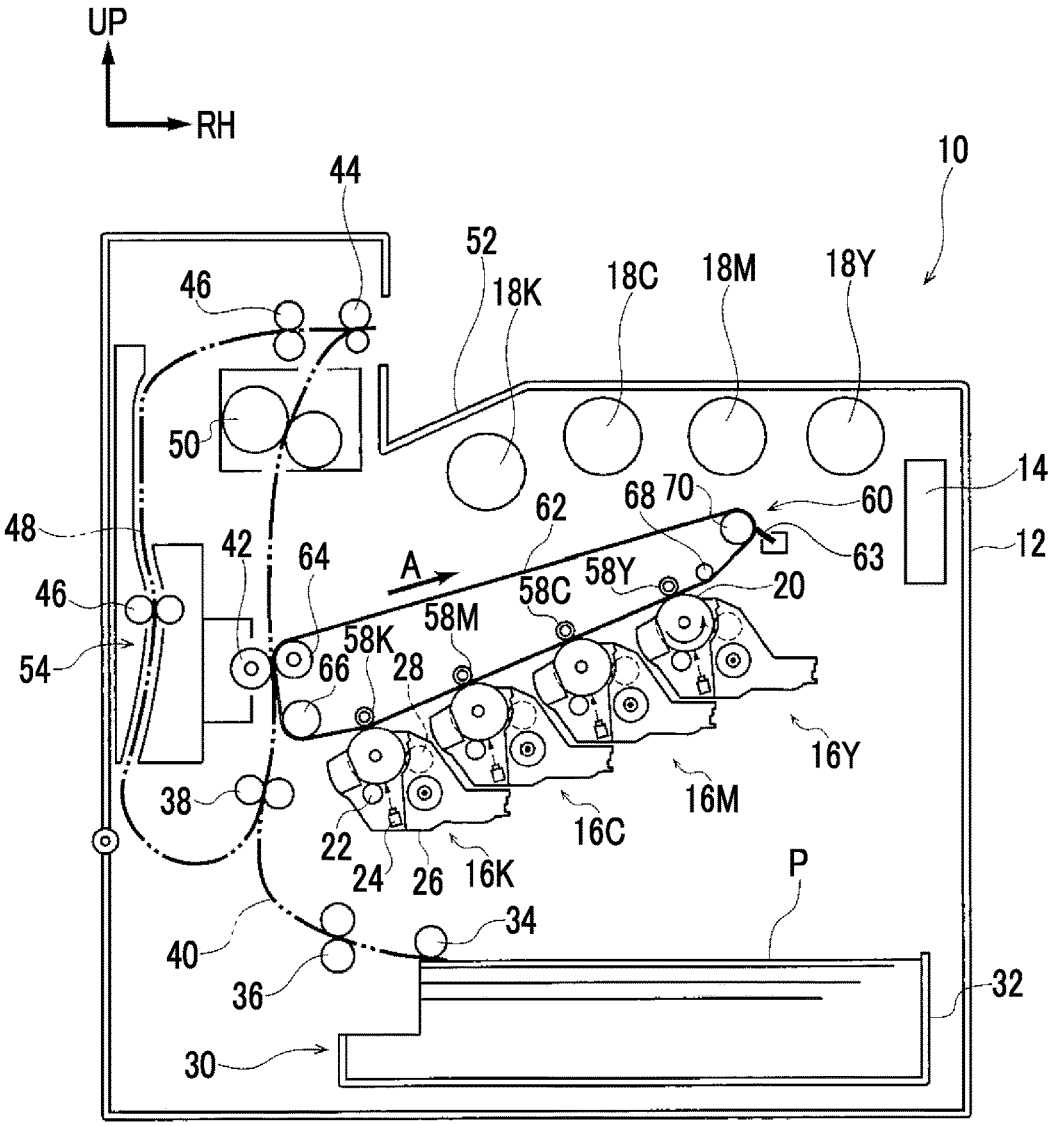
FIG. 1 is a front view illustrating a configuration of an image forming apparatus according to the present exemplary embodiment.

Hereinafter, an exemplary embodiment according to the present invention will be described in detail with reference to the accompanying drawings. Meanwhile, for convenience of description, an arrow UP illustrated in FIG. 1 is set to be an upper direction of an image forming apparatus 10, and an arrow RH is set to be a right direction of the image forming apparatus 10. In addition, a front direction of the paper in FIG. 1 is set to be a front direction of the image forming apparatus 10. In addition, in FIGS. 2, 3, 7, and 8, a primary transfer unit 60 is illustrated in a state of not being inclined in a right-left direction, and a direction in a case where the primary transfer unit 60 is slightly inclined in the right-left direction is also set to be a "right-left direction".

As illustrated in FIG. 1, an image processing unit 14 performing image processing on image data to be input is provided inside an apparatus main body 12 of the image forming apparatus 10. The image processing unit 14 processes the input image data to four-color tone data of yellow (Y), magenta (M), cyan (C), and black (K).

Image forming units 16Y, 16M, 16C, and 16K as examples of image forming sections that form toner images of yellow (Y), magenta (M), cyan (C), and black (K) colors are disposed on the center side of the apparatus main body 12 so as to be inclined in the right-left direction. The image forming units 16Y, 16M, 16C, and 16K of the respective colors are configured to be capable of being drawn out to the front side from the apparatus main body 12, and a front wall of the apparatus main body 12 is configured to be openable and closable. Meanwhile, hereinafter, when it is not necessary to give a description by distinguishing between the colors, the alphabetic characters of Y, M, C, and K will be omitted.

The image forming units 16 of the respective colors are configured in the same manner. Each of the image forming units includes a cylindrical image holding member 20 which is rotatable, a charger 22 that charges the surface of the image holding member 20, an LED head 24 that irradiates the charged surface of the image holding member 20 with exposure light to thereby forming an electrostatic latent image, a developing device 26 that develops the electrostatic latent image formed by the LED head 24 using a toner (developer) and visualizes the developed electrostatic latent image as a toner image, and a cleaning blade (not shown) that cleans the surface of the image holding member 20.

The developing device 26 includes a developing roller 28 which is disposed facing the image holding member 20 and is configured such that an electrostatic latent image on the image holding member 20 is developed by a toner supplied from the developing roller 28 and is visualized as a toner image. Meanwhile, the charger 22, the LED head 24, the developing roller 28, and the cleaning blade face the surface of the image holding member 20, and are disposed in this order from an upstream side of the image holding member 20 in a rotation direction toward a downstream side thereof.

Figure 2:
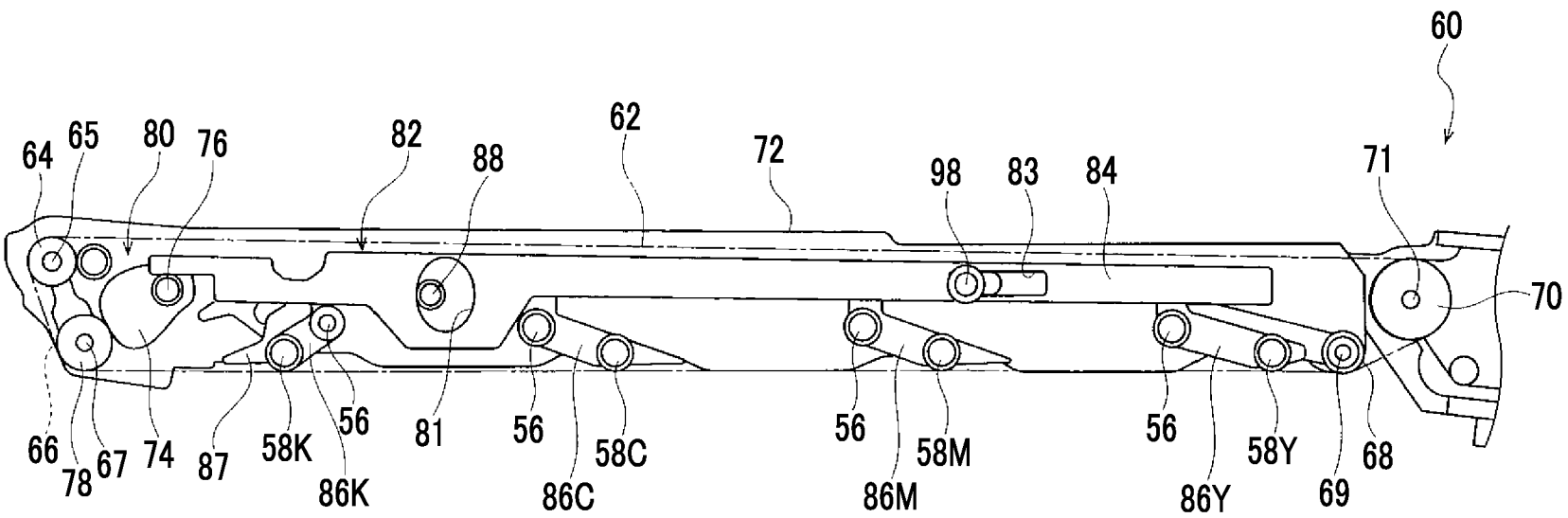
FIG. 2 is a front view illustrating the image formation of a primary transfer unit according to the present exemplary embodiment.
Figure 3:
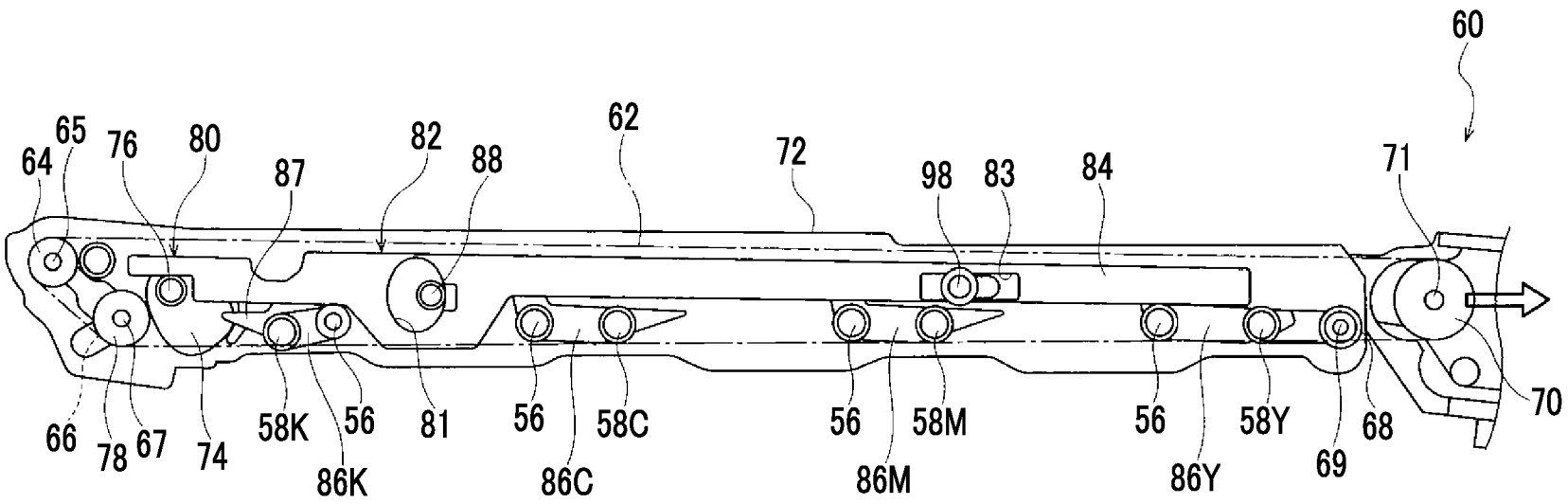
FIG. 3 is a front view illustrating the retraction of the primary transfer unit according to the present exemplary embodiment.

The primary transfer unit 60 having toner images, formed by the image forming units 16 of the respective colors, multiply transferred thereto is disposed on the upper side of the image forming units 16 of the respective colors. As illustrated in FIGS. 1 to 3, the primary transfer unit 60 as an example of a transfer device includes an endless intermediate transfer belt 62 to which a toner image is multiply transferred, and a driving roller 64, a sensor roller 66, a leveling forming roller 68, and a tension applying roller 70 on which the intermediate transfer belt 62 is wound.

The driving roller 64 circulates the intermediate transfer belt 62 in a direction of an arrow A by its own rotation. The tension applying roller 70 is urged in the right direction (direction receding from the driving roller 64) at all times by a compression coil spring 100 (see FIGS. 8A and 8B) as an urging member, and applies tension to the intermediate transfer belt 62.

Meanwhile, the sensor roller 66 that detects the toner image multiply transferred onto the intermediate transfer belt 62 is disposed on the lower side of the driving roller 64. In addition, the leveling forming roller 68 setting the position of the intermediate transfer belt 62 is disposed on the lower side of the tension applying roller 70 in order to bring the intermediate transfer belt 62 supported by a primary transfer roller 58 to be described later into contact with the image holding members 20 of the respective colors.

The primary transfer unit 60 includes plural (four) primary transfer rollers 58 which are disposed on the side opposite to the image holding members 20 of the respective colors with the intermediate transfer belt 62 interposed therebetween. Primary transfer rollers 58Y, 58M, 58C, and 58K of the respective colors are disposed at intervals on the inner circumferential surface side of the intermediate transfer belt 62 between the sensor roller 66 and the leveling forming roller 68, and press the intermediate transfer belt 62 against the image holding member 20 so as to bring the intermediate transfer belt 62 into contact with the image holding members 20 of the respective colors.

Thereby, the toner images of yellow (Y), magenta (M), cyan (C), and black (K) colors which are formed on the image holding members 20 of the respective colors are sequentially transferred (multiply transferred) onto the intermediate transfer belt 62. Meanwhile, a cleaning blade 63 that comes into contact with the surface of the intermediate transfer belt 62 and cleans a residual toner remaining on the surface without being primarily transferred is also disposed in the primary transfer unit 60.

In addition, the primary transfer unit 60 is provided with a retracting mechanism 80 (see FIGS. 2 and 3) that moves the primary transfer rollers 58 upward at the time of drawing the image forming units 16 of the respective colors out of the apparatus main body 12 to separate the intermediate transfer belt 62 from the image holding members 20 of the respective colors. Meanwhile, the retracting mechanism 80 will be described later in detail.

As illustrated in FIG. 1, toner cartridges 18 of respective colors which are capable of being attached to and detached from the apparatus main body 12 and which are filled with a toner to be replenished to the developing device 26 are disposed on the upper side of the primary transfer unit 60 so as to be lined up. The toner cartridges 18 of the respective colors are connected to the developing devices 26 of the respective colors through a replenishing pipe (not shown).

On the other hand, a supply transporting unit 30 that supplies and transports recording paper P as an example of a recording sheet is disposed on the lower side of the image forming units 16 of the respective colors. The supply transporting unit 30 includes a paper feeding unit 32 having the plural pieces of recording paper P accumulated therein, a paper feeding roller 34 that sends out the pieces of recording paper P accumulated in the paper feeding unit 32 to a transporting path 40, and a separation roller 36 that separates the pieces of recording paper P sent out by the paper feeding roller 34 one by one.

The supply transporting unit 30 includes a positioning roller 38 that adjusts a transport timing of the recording paper P. Therefore, the recording paper P which is supplied from the paper feeding unit 32 and is transported by the paper feeding roller 34 and the separation roller 36 is sent out at a timing when the recording paper is determined to be a contact portion (secondary transfer position) between the intermediate transfer belt 62 and a secondary transfer roller 42 to be described later by the positioning roller 38.

The secondary transfer roller 42 that transfers the toner image, multiply transferred onto the intermediate transfer belt 62 of the primary transfer unit 60, to the recording paper P transported along the transporting path 40 by the supply transporting unit 30 is provided on the left side of the primary transfer unit 60. The secondary transfer roller 42 is provided on the side opposite to the driving roller 64 with the intermediate transfer belt 62 interposed therebetween, and is grounded.

The driving roller 64 forms a counter electrode of the secondary transfer roller 42, and a secondary transfer voltage is applied thereto. Thereby, the toner image multiply transferred onto the intermediate transfer belt 62 is transferred to the recording paper P at the contact portion (secondary transfer position) between the intermediate transfer belt 62 and the secondary transfer roller 42.

A fixing device 50 that fixes the toner image, transferred to the recording paper P, onto the recording paper P by heat and pressure is provided on the side closer to the downstream side of the recording paper P in a transport direction than the secondary transfer roller 42. A discharge roller 44 that exits the recording paper P having the toner image fixed thereto to an exit section 52 provided in the upper portion of the apparatus main body 12 is provided on the side closer to the downstream side of the recording paper P in the transport direction than the fixing device 50.

In addition, in order to form a toner image on the other surface of the recording paper P having one surface onto which a toner image is fixed by the fixing device 50, the supply transporting unit 30 is provided with a reversal transport device 54 that transports the recording paper P to the secondary transfer position. The reversal transport device 54 includes a reversal path 48 that reverses the front and back sides of the recording paper P and transports the recording paper toward the positioning roller 38 from the discharge roller 44, and a transport roller 46 that transports the recording paper P along the reversal path 48.

Next, an image forming process of the image forming apparatus 10 configured as described above will be briefly described.

First, pieces of tone data of the respective colors are output from the image processing unit 14 to the LED heads 24 of the respective colors. The surfaces of the image holding members 20 of the respective colors which are charged by the charger 22 are irradiated with exposure light emitted from the LED heads 24 of the respective colors in accordance with the pieces of tone data of the respective colors. Thereby, an electrostatic latent image is formed on the surfaces of the image holding members 20 of the respective colors.

The electrostatic latent images formed on the image holding members 20 of the respective colors are developed by the developing devices 26 of the respective colors, and are visualized as toner images of yellow (Y), magenta (M), cyan (C), and black (K) colors. The toner images of the respective colors which are formed on the image holding members 20 of the respective colors are sequentially transferred (multiply transferred) onto the circulating intermediate transfer belt 62 by the primary transfer roller 58 of the primary transfer unit 60.

The toner images of the respective colors multiply transferred onto the circulating intermediate transfer belt 62 are secondarily transferred to the recording paper P, transported along the transporting path 40 from the paper feeding unit 32 by the paper feeding roller 34, the separation roller 36, and the positioning roller 38, at the secondary transfer position by the secondary transfer roller 42. The recording paper P having the toner images secondarily transferred thereto is transported to the fixing device 50, and the toner images are fixed onto the recording paper P by the fixing device 50.

The recording paper P having the toner image fixed to the surface thereof by the fixing device 50 is discharged onto the exit section 52 by the discharge roller 44, or is transported to the secondary transfer position again by the reversal transport device 54, and the toner image is transferred to the rear surface thereof. The recording paper P having the toner image transferred to the rear surface thereof is transported to the fixing device 50. As described above, the toner image is fixed and is discharged onto the exit section 52.

Next, the retracting mechanism 80 of the primary transfer unit 60 of the image forming apparatus 10 configured as described above will be described in detail.

Figure 4:
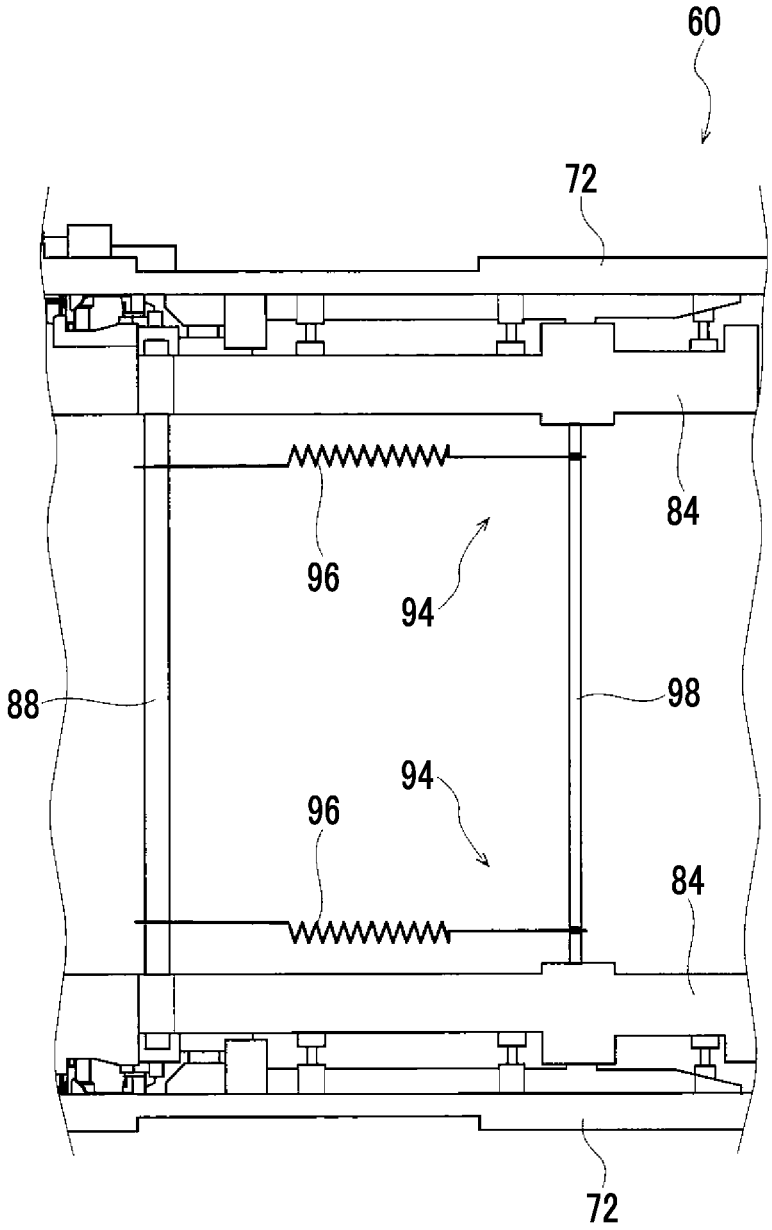
FIG. 4 is a plan view illustrating a portion of the primary transfer unit according to the present exemplary embodiment.

As illustrated in FIGS. 2 to 4, the primary transfer unit 60 includes a frame 72, extending in the right-left direction, on the front portion side and the rear portion side thereof, and a rotation axis 65 of the driving roller 64, a rotation axis 67 of the sensor roller 66, and a rotation axis 69 of the leveling forming roller 68 are rotatably supported by the frames 72 on the front and back sides. Meanwhile, the sensor roller 66 and the leveling forming roller 68 are configured to move upward during retraction to be described later.

The primary transfer rollers 58 of the respective colors are supported by link mechanisms 82 provided in the respective frames 72, and are configured to move upward about respective support shafts 56 during retraction to be described later. The link mechanism 82 includes a slider 84 as an example of a movement member which is configured to be movable in the right-left direction inside the frame 72 in the front-back direction.

The slider 84 extends in the right-left direction, and upper ends of arm members 86Y, 86M, and 86C of yellow (Y), magenta (M), and cyan (C) colors having a substantially L shape, when seen in a front view, are rotatably attached to an appropriate position of the slider in the right-left direction. Bent portions of the respective arm members 86Y, 86M, and 86C are rotatably supported by the support shafts 56, and the primary transfer rollers 58Y, 58M, and 58C are rotatably supported by the lower ends of the respective arm members 86Y, 86M, and 86C.

In addition, the upper end of an black (K) arm member 86K is attached to a supporting member 87 constituting the link mechanism 82 through the support shaft 56, and the primary transfer roller 58K is rotatably supported by the lower end of the arm member 86K. The supporting member 87 is configured to move the primary transfer roller 58K upward when the slider 84 moves in the left direction during retraction to be described later.

In addition, a cam member 74 is fixed to a support shaft 76 at the left end of the primary transfer unit 60, and the cam member 74 is configured to rotate by manually (handle not shown in the drawing) rotating the support shaft 76. The cam member 74 presses a cam receiving member 78 rotatably provided in the rotation axis 67 of the sensor roller 66 to thereby position the sensor roller 66 in a direction receding from the support shaft 76 as illustrated in FIG. 2.

This state is an image forming posture of the primary transfer unit 60, and the primary transfer roller 58 of the respective colors are configured to take contact positions for bringing the intermediate transfer belt 62 into contact with the image holding members 20 of the respective colors, as illustrated in FIG. 2. In other words, the intermediate transfer belt 62 pressed and supported by the primary transfer rollers 58 of the respective colors from the inner circumferential surface side comes into contact with the image holding members 20 of the respective colors.

Figure 5A:
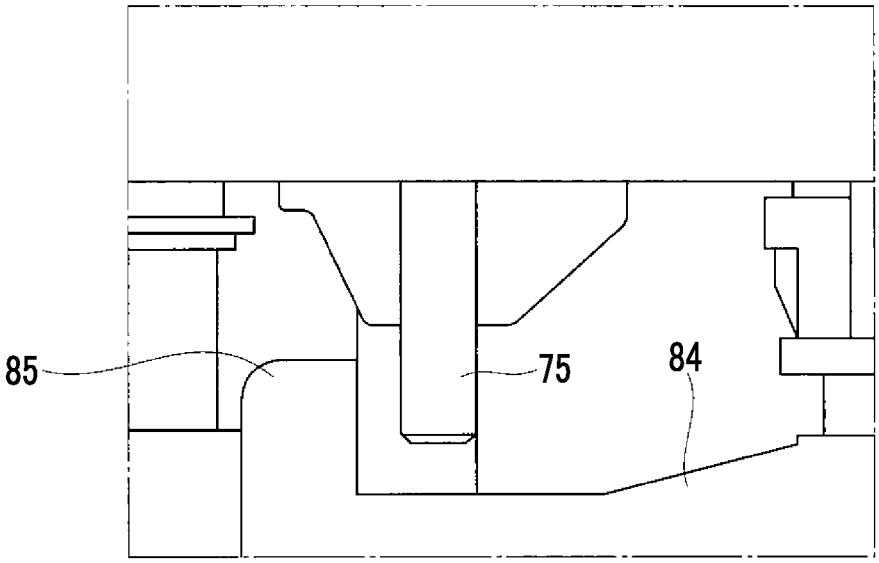
FIGS. 5A and 5B are enlarged plan views illustrating a mechanism that slides a slider of the primary transfer unit according to the present exemplary embodiment.
Figure 5B:
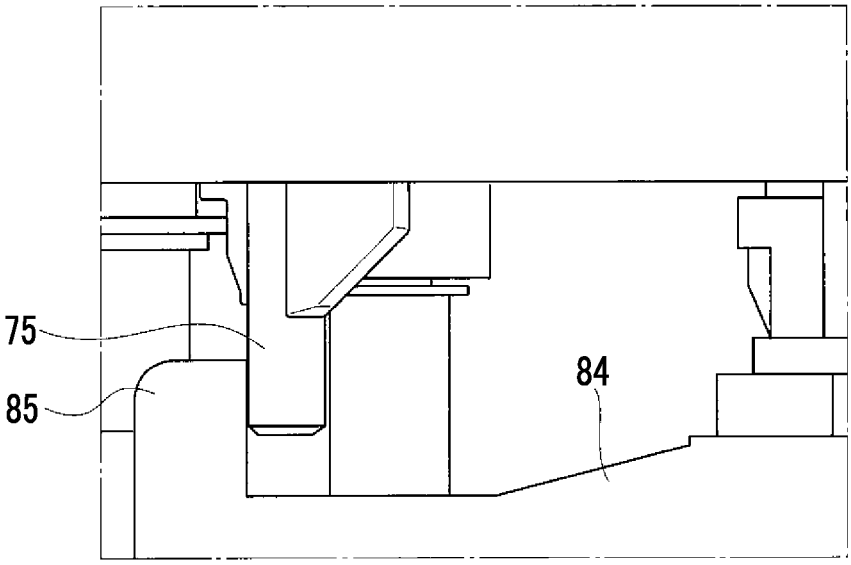

On the other hand, as illustrated in FIG. 3, when the cam member 74 is rotated counterclockwise in FIG. 3, the rotation axis 67 of the sensor roller 66 moves in a direction approaching the support shaft 76. As illustrated in FIGS. 5A and 5B, a to-be-engaged portion 85 formed to protrude toward the back side of the slider 84 in the left end moves in the left direction in a state of engaging with an engagement portion 75 associated with the cam member 74, and the slider 84 moves in the left direction.

Thereby, the arm members 86Y, 86M, and 86C are rotated counterclockwise in FIG. 3 about the support shaft 56, and the arm member 86K is rotated clockwise in FIG. 3 about the support shaft 56. Accordingly, the primary transfer rollers 58 of the respective colors move upward, and the intermediate transfer belt 62 is separated from the image holding members 20 of the respective colors.

This state is a retraction posture of the primary transfer unit 60, and the primary transfer rollers 58 of the respective colors are configured to take separation positions for separating the intermediate transfer belt 62 from the image holding members 20 of the respective colors, as illustrated in FIG. 3. The tension applying roller 70 is urged in the right direction (direction receding from the driving roller 64) at all times by the compression coil spring 100 (see FIGS. 8A and 8B), and thus moves in the right direction (direction receding from the driving roller 64).

Here, when an urging force of the tension applying roller 70 which is applied in the direction receding from the driving roller 64 is excessively strong, the tension of a portion of the intermediate transfer belt 62 which is wound around the tension applying roller 70 becomes stronger than necessary, which results in a tendency for curling to be caused. For this reason, the retracting mechanism 80 of the primary transfer unit 60 according to the present exemplary embodiment is provided with a relaxation mechanism 90 (see FIG. 7) relaxing an urging force of the tension applying roller 70 which is applied in the right direction (direction receding from the driving roller 64).

Figure 6:
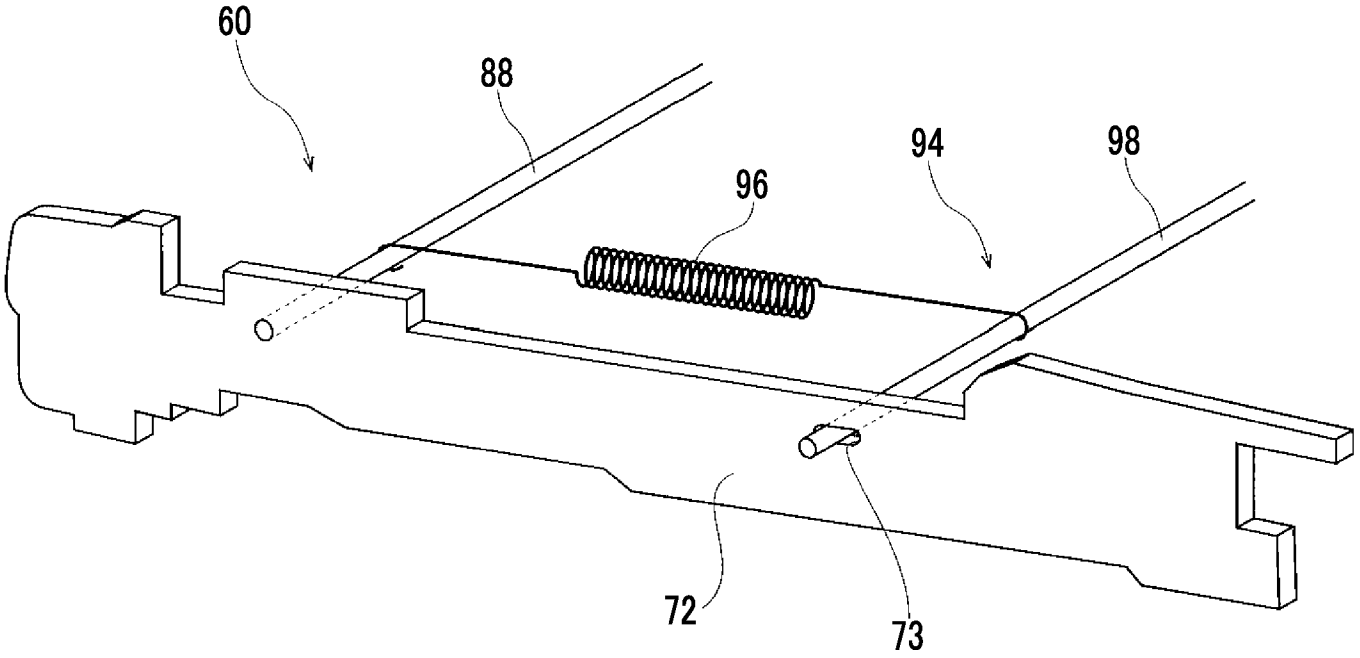
FIG. 6 is a perspective view illustrating a configuration of an urging unit of the primary transfer unit according to the present exemplary embodiment.
Figure 7:
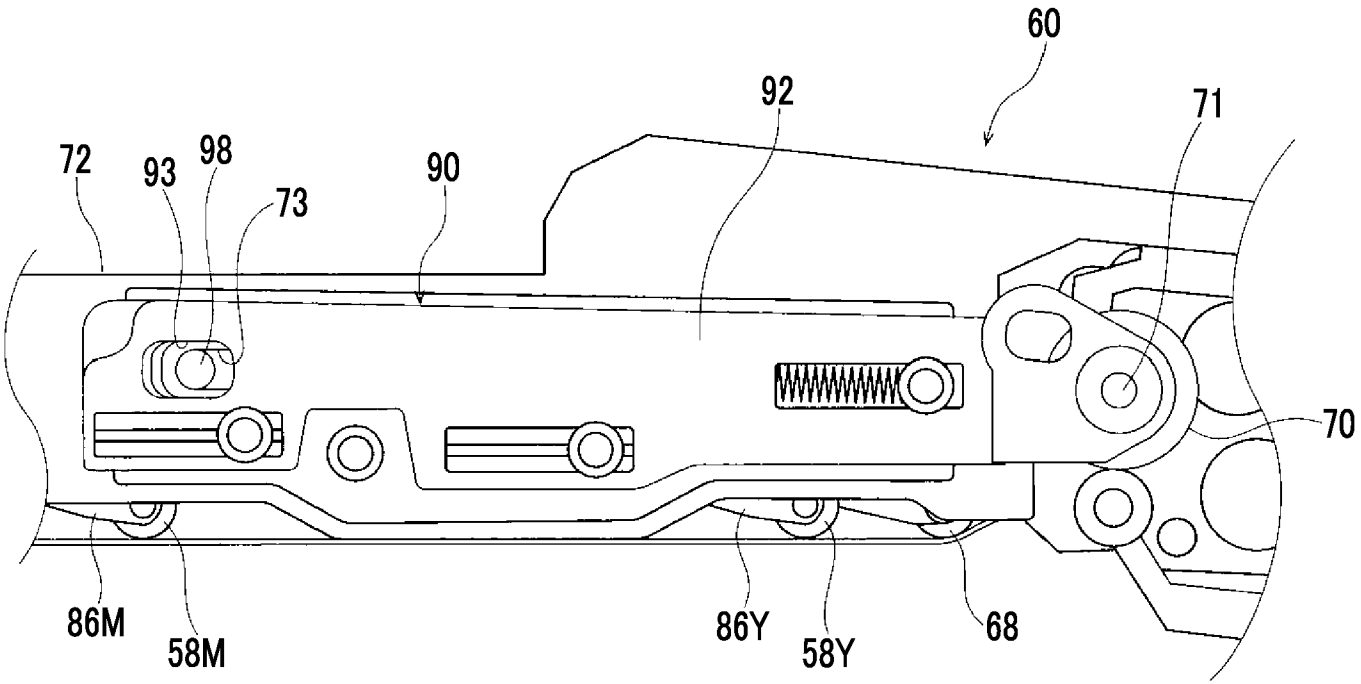
FIG. 7 is a front view illustrating a relaxing member of the primary transfer unit according to the present exemplary embodiment.

In detail, as illustrated in FIG. 7, the relaxation mechanism 90 includes a relaxing member 92 of which one end is attached to a rotation axis 71 as an example of a shaft portion of the tension applying roller 70. The relaxing member 92 is disposed on the outer side of the frame 72 (slider 84) in the front-back direction, and the right-left direction serves as a longitudinal direction. The relaxing member 92 is urged in the left direction (direction approaching the driving roller 64) at all times by an urging unit 94 illustrated in FIGS. 4 and 6.

As illustrated in FIGS. 4 and 6, the urging unit 94 includes an extension coil spring 96 of which the left end (one end) is attached to a shaft 88, extending in the front-back direction and having both ends respectively fixed to the frames 72 on the front and back sides, and a shaft 98 extending in the front-back direction (axial direction of the tension applying roller 70) and having the right end (the other end) of the extension coil spring 96 attached thereto.

Both ends of the shaft 98 pass through a long hole portion 83 (see FIGS. 2 and 3) formed in the slider 84 and are inserted into a long hole portion 73 (see FIG. 6) formed in the frame 72. Meanwhile, both ends of the shaft 88 also pass through a hole portion 81 (see FIGS. 2 and 3) formed in the slider 84 and are fixed to the frame 72. In addition, in FIG. 6, only the frame 72 is shown, and the slider 84 and the like are not shown.

Figure 8A:
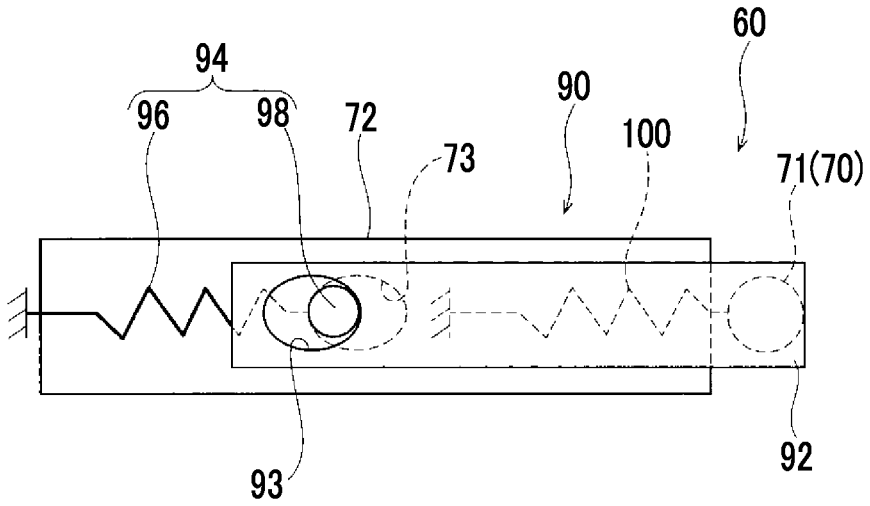
FIGS. 8A and 8B are schematic diagrams illustrating the relaxing member of the primary transfer unit according to the present exemplary embodiment.

As illustrated in FIG. 6 and FIG. 8A, the long hole portion 73 is formed to have a substantially elliptical shape in which the right-left direction is set to be a longitudinal direction, and both ends of the shaft 98 are held while coming into contact with a left side edge portion of the long hole portion 73 (pressing the left side edge portion of the long hole portion 73 to the left) by an urging force of the extension coil spring 96 during image formation in which the primary transfer roller 58 takes an image forming posture (contact position).

In addition, as illustrated in FIG. 7 and FIG. 8A, both ends of the shaft 98 are also inserted into a long hole portion 93 as an example of a hole portion formed in the relaxing member 92. The long hole portion 93 is formed to have a substantially elliptical shape in which the right-left direction is set to be a longitudinal direction, and both ends of the shaft 98 are configured not to come into contact with right and left side edge portions of the long hole portion 93 (or not to press the right and left side edge portions in the right and left directions in spite of coming into contact therewith) during image formation in which the primary transfer roller 58 takes an image forming posture.

Figure 8B:
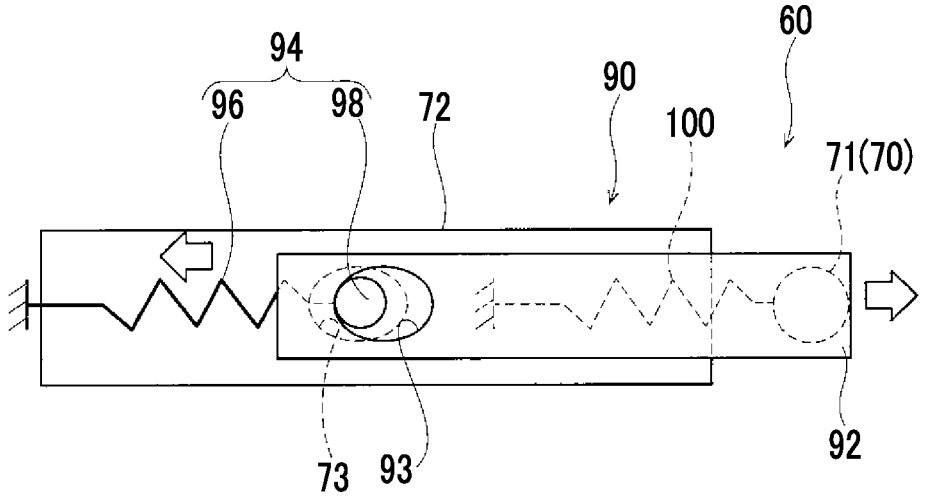

During retraction in which the primary transfer roller takes a retraction posture (separation position), the tension applying roller 70 moves in the right direction (direction receding from the driving roller 64) by an urging force of the compression coil spring 100, and the relaxing member 92 moves in the right direction, but the movement is suppressed by the shaft 98 inserted into the long hole portion 93. That is, as illustrated in FIG. 8B, when the relaxing member 92 moves in the right direction, the left side edge portion of the long hole portion 93 comes into contact with both ends of the shaft 98 to attempt to move the shaft 98 in the right direction.

However, since the shaft 98 is urged in the left direction at all times by the extension coil spring 96, the movement of the shaft 98 in the right direction is suppressed by an urging force of the extension coil spring 96. Accordingly, an urging force of the tension applying roller 70 in the right direction is relaxed through the relaxing member 92, and the tension of the intermediate transfer belt 62 wound around the tension applying roller 70 is reduced to the extent of not causing curling.

Meanwhile, when the tension of the intermediate transfer belt 62 at this time (during retraction in which the primary transfer roller 58 takes a retraction posture) is set to be T, the tension of the intermediate transfer belt 62 generated due to the weight of at least four primary transfer rollers 58 is set to be Tm, and the tension of the intermediate transfer belt 62 when curling occurs in the intermediate transfer belt 62 is set to be Te, the relation of $Tm<T<Te$ is satisfied.

Next, operations of the primary transfer unit 60 including the retracting mechanism 80 (relaxation mechanism 90) configured as described above will be described.

When the image forming units 16 of the respective colors are drawn out of the apparatus main body 12, the intermediate transfer belt 62 is separated from the image holding members 20 of the respective colors by the retracting mechanism 80. That is, the cam member 74 is rotated counterclockwise in FIG. 3 by operating a handle not shown in the drawing. Then, as illustrated in FIGS. 5A and 5B, the to-be-engaged portion 85 of the slider 84 moves in the left direction in a state of engaging with the engagement portion 75 associated with the cam member 74, and the slider 84 moves in the left direction.

Thereby, the arm member 86 of the link mechanism 82 rotates about the support shaft 56, and thus the primary transfer roller 58 moves upward, and pressing against the intermediate transfer belt 62 from the inner circumferential surface side of the primary transfer roller 58 is released. In other words, the intermediate transfer belt 62 is separated from the image holding members 20 of the respective colors. Accordingly, the image forming units 16 of the respective colors may be drawn out of the apparatus main body 12.

On the other hand, when the cam member 74 is rotated counterclockwise in FIG. 3, the rotation axis 67 of the sensor roller 66 moves in a direction approaching the support shaft 76 of the cam member 74, and the tension applying roller 70 urged in the right direction at all times by the compression coil spring 100 moves in the right direction (direction receding from the driving roller 64).

When the tension applying roller 70 moves in the right direction, the relaxing member 92 attached to the rotation axis 71 moves in the right direction, but the shaft 98 is inserted into the long hole portion 93 of the relaxing member 92. Here, the shaft 98 is urged in the left direction (direction approaching the driving roller 64) at all times by the extension coil spring 96.

Therefore, as illustrated in FIG. 8B, when the relaxing member 92 moves in the right direction, the left side edge portion of the long hole portion 93 comes into contact with both ends of the shaft 98, and the movement of the relaxing member 92 in the right direction is suppressed by the extension coil spring 96 through the shaft 98. In other words, the tension applying roller 70 is held at a position where an urging force of the compression coil spring 100 for urging the tension applying roller 70 in the right direction and an urging force of the extension coil spring 96 for urging the relaxing member 92 in the left direction through the shaft 98 are balanced with each other.

Thereby, an urging force of the tension applying roller 70 in the right direction is relaxed during retraction in which the primary transfer roller 58 takes a retraction posture, and the tension of the intermediate transfer belt 62 wound around the tension applying roller 70 is reduced, compared to the case of the primary transfer unit 60 that does not include the relaxation mechanism 90. Accordingly, the occurrence of curling in the intermediate transfer belt 62 is suppressed or prevented by the tension applying roller 70.

At this time, the relation of $T<Te$ is established as described above. Therefore, the occurrence of curling in the intermediate transfer belt 62 is suppressed or prevented, compared to a configuration in which the relation of $T\geq Te$ is established. In addition, the occurrence of an image defect due to the curling occurring in the intermediate transfer belt 62 is suppressed or prevented. At this time, the relation of $T>Tm$ is established as described above. Therefore, the damage of the intermediate transfer belt 62, which is caused by the intermediate transfer belt being loosened downward and coming into contact with a component (for example, the image forming unit 16 or the like) inside the apparatus main body 12, is suppressed or prevented compared to a configuration in which the relation of $T\leq Tm$ is established.

In addition, in the primary transfer unit 60 according to the present exemplary embodiment, the urging unit 94 for suppressing the movement of the relaxing member 92 in the right direction is configured to include the shaft 98 and the extension coil spring 96. Therefore, there is an advantage in that the configuration of the urging unit 94 is simplified, compared to a case where the urging unit 94 is not configured to include the shaft 98 and the extension coil spring 96.

While the primary transfer unit 60 (transfer device) according to the present exemplary embodiment has been described so far with reference to the accompanying drawings, the primary transfer unit 60 according to the present exemplary embodiment is not limited to that shown in the drawing and may be appropriately modified in design without departing from the scope of the present invention. For example, the urging unit 94 is not limited to being constituted by the shaft 98 and the extension coil spring 96.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a plurality of primary transfer rollers, each of which selectively takes (i) a contact position where an intermediate transfer belt is brought into contact with a corresponding image holding member, and (ii) a separation position where the intermediate transfer belt is separated from the corresponding image holding member;

a tension applying roller on which the intermediate transfer belt is wound thereon together with a driving roller and which is urged in a direction receding from the driving roller; and a relaxing member that is attached to a shaft portion of the tension applying roller, is urged by an urging unit in a direction approaching the driving roller, and relaxes an urging force of the tension applying roller in a direction receding from the driving roller when at least four of the plurality of primary transfer rollers are at the separation position, wherein when the at least four primary transfer rollers are at the separation position, tension of the intermediate transfer belt is larger than that generated due to the weight of the at least four primary transfer rollers at the contact position.

2. The transfer device according to claim 1, wherein the urging unit includes:

a shaft that extends in an axial direction of the tension applying roller and is inserted into a hole portion formed on the relaxing member, and an extension coil spring that urges the shaft in a direction approaching the driving roller.

3. An image forming apparatus comprising:

an image forming section that forms an image on an image holding member; and the transfer device according to claim 1, which further includes the intermediate transfer belt to which the image on the image holding member is primarily transferred.

4. An image forming apparatus comprising:

an image forming section that forms an image on an image holding member; and the transfer device according to claim 1, which further includes the intermediate transfer belt to which the image on the image holding member is primarily transferred.

5. The transfer device according to claim 1, wherein the tension of the intermediate transfer belt when the at least four primary transfer rollers are at the separation position is less than that at which curling occurs in the intermediate transfer belt.

6. The transfer device according to claim 1, wherein the urging unit of the relaxing member is between the tension applying roller and the driving roller.

7. The transfer device according to claim 6, wherein the urging unit of the relaxing member is between the tension applying roller and a said primary transfer roller.

8. The transfer device according to claim 2, wherein:

the shaft does not contact an edge of the hole portion when the at least four primary transfer rollers are at the contact position; and the shaft contacts the edge of the hole portion when the at least four primary transfer rollers are at the separation position.

9. The transfer device according to claim 8, wherein the edge is a part of the hole portion that is farthest from the tension applying roller.

10. The transfer device according to claim 9, wherein the hole portion is substantially elliptical.

* * * * *